US011555404B2

(12) United States Patent
Kim et al.

(10) Patent No.: US 11,555,404 B2
(45) Date of Patent: Jan. 17, 2023

(54) ROTARY COMPRESSOR HAVING A COMBINED VANE-ROLLER STRUCTURE INCLUDING A FERROSOFERRIC OXIDE FILM ON A SURFACE OF A COUPLING GROOVE OF THE ROLLER

(71) Applicant: LG Electronics Inc., Seoul (KR)

(72) Inventors: Ki Sun Kim, Seoul (KR); Sangha Lee, Seoul (KR); Jebyoung Moon, Seoul (KR); Taeyoung Noh, Seoul (KR); Jaeyeol Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 16/910,856

(22) Filed: Jun. 24, 2020

(65) Prior Publication Data

US 2020/0408097 A1 Dec. 31, 2020

(30) Foreign Application Priority Data

Jun. 26, 2019 (KR) ..... 10-2019-0076681

(51) Int. Cl.
*F01C 21/08* (2006.01)
*F04C 18/356* (2006.01)
(Continued)

(52) U.S. Cl.
CPC ..... *F01C 21/0809* (2013.01); *B22F 3/10* (2013.01); *B22F 3/24* (2013.01); *B22F 5/008* (2013.01);
(Continued)

(58) Field of Classification Search
CPC ..... F04C 18/324
See application file for complete search history.

(56) References Cited

U.S. PATENT DOCUMENTS 4,904,302 A * 2/1990 Shimomura ..... F01C 21/08 419/17
4,944,663 A * 7/1990 Iizuka ..... F01C 21/0809 418/179
(Continued)

FOREIGN PATENT DOCUMENTS

CN 1170089 1/1998
CN 101042125 9/2007
(Continued)

OTHER PUBLICATIONS

Office Action in Chinese Appln. No. 202010590123.0, dated Dec. 3, 2021, 14 pages (with English translation).
(Continued)

*Primary Examiner* — Laert Dounis
(74) *Attorney, Agent, or Firm* — Fish & Richardson P.C.

(57) ABSTRACT

A rotary compressor has a combined vane-roller structure that may ensure improved productivity and reliability through control of mechanical properties. The rotary compressor includes a coupling groove which is disposed at one side of an outer circumferential surface of the roller, which has a circular arc shape from an outer diameter of the roller towards an inner diameter of the roller, and which is configured to couple a vane and the roller, and includes a ferrosoferric oxide ($Fe_3O_4$) film on a surface of the coupling groove. A manufacturing method of the rotary compressor is also described.

16 Claims, 11 Drawing Sheets

(51) Int. Cl.

| | |
|---|---|
| ***F04C 23/00*** | (2006.01) |
| ***F04C 18/324*** | (2006.01) |
| ***B22F 3/10*** | (2006.01) |
| ***B22F 3/24*** | (2006.01) |
| ***B22F 5/00*** | (2006.01) |

(52) U.S. Cl.

CPC ..... *F04C 18/324* (2013.01); *F04C 18/3564* (2013.01); *F04C 23/001* (2013.01); *F04C 23/008* (2013.01); *B22F 2003/248* (2013.01); *B22F 2201/05* (2013.01); *B22F 2301/35* (2013.01)

(56) References Cited

U.S. PATENT DOCUMENTS

| | | | | |
|---|---|---|---|---|
| 5,090,882 | A | 2/1992 | Serizawa et al. | |
| 2017/0275996 | A1* | 9/2017 | Cho | F01C 21/0809 |

FOREIGN PATENT DOCUMENTS

| | | | | | |
|---|---|---|---|---|---|
| CN | 101285469 | | | 10/2008 | |
| CN | 101758220 | | | 6/2010 | |
| CN | 106715912 | | | 5/2017 | |
| CN | 109236650 | | | 1/2019 | |
| JP | 63088294 | A | * | 4/1988 | F01C 21/0809 |
| JP | 2005113842 | A | * | 4/2005 | |
| JP | 201152592 | | | 3/2011 | |
| KR | 100201207 | | | 6/1999 | |
| KR | 100230790 | | | 11/1999 | |
| KR | 1020160034071 | | | 3/2016 | |

OTHER PUBLICATIONS

Extended European Search Report in European Appln. No. 20182000.8, dated Sep. 24, 2020, 7 pages.

Korean Office Action in Korean Appln. No. 10-2020-057704214, dated Aug. 24, 2020, 13 pages (with English translation).

* cited by examiner

340

(a)

(b)

<ABRASION OF CROSS SECTION OF ROLLER>

(a)

<ABRASION OF CROSS SECTION OF M/B>

<ABRASION OF CROSS SECTION OF S/S>

(b)

<GOOD CROSS SECTION OF ROLLER>

(a)

<GOOD CROSS SECTION OF BEARING>

(b)

ROTARY COMPRESSOR HAVING A COMBINED VANE-ROLLER STRUCTURE INCLUDING A FERROSOFERRIC OXIDE FILM ON A SURFACE OF A COUPLING GROOVE OF THE ROLLER

CROSS-REFERENCE TO RELATED APPLICATION

This application claims priority to and the benefit of Korean Patent Application No. 10-2019-0076681, filed in Korea on Jun. 26, 2019, the disclosure of which is incorporated herein by reference in its entirety.

TECHNICAL FIELD

The present disclosure relates to a rotary compressor that can ensure improved productivity and reliability through control of mechanical properties and a manufacturing method of a roller in a rotary compressor having a combined vane-roller structure (also referred to as a combined roller-vane structure).

BACKGROUND

In general, compressors denote a device for compressing refrigerants. They can be classified as a reciprocating compressor, a centrifugal compressor, a vane-type compressor, a scroll-type compressor and the like.

Among the compressors, a rotary compressor is a compressor that compresses refrigerants using a roller (also referred to as a rolling piston) which eccentrically rotates in a compression space of a cylinder and using a vane which contacts an outer circumferential surface of the roller and divides the compression space of the cylinder into a suction chamber and a discharge chamber.

In a rotary compressor of the related art, refrigerants leaks from between the roller and the vane, thereby deteriorating performance of the compressor.

Recently, a rotary compressor having a combined vane-roller structure, where the vane is inserted into the roller and connected to the roller, has been introduced as a means to resolve the above-describe problem of a leak between the roller and the vane.

FIG. 1 is an enlarged view illustrating a roller of a rotary compressor having a combined vane-roller structure of the related art. In the rotary compressor having a combined roller-vane structure of the related art, a coupling groove, which is disposed at one side of an outer circumferential surface of a ring-shaped roller and to which the vane is fixed (or coupled), has a shape which is depressed substantially perpendicularly in a direction of a center of the roller on the outer circumferential surface of the roller/depressed substantially perpendicularly from the outer circumferential surface of the roller towards a center of the roller.

In the rotary compressor having a combined vane-roller structure of the related art, the roller is usually applied to a component such as a shaft or an axle and the like which experiences a high level of stress, and is manufactured using thermally treated SNCM 815 steel (its specification is defined according to the KS D3867 or JIS G4053 standards) referred to as Ni—Cr—Mo steel. Strength and toughness of Ni—Cr—Mo steel are adjusted through the heat treatment of quenching and tempering and then used. Thus, the roller of the related art, which is quenched and then tempered, has high hardness of about 550 Hv on the basis of the commonly-used Vickers hardness scale.

When Ni—Cr—Mo steel is applied to a roller of a rotary compressor having a combined vane-roller structure, it is difficult to process a coupling groove of the roller, to which the vane is coupled.

Specifically, in the rotary compressor of the related art as in FIG. 1, a shape of the coupling groove of the roller, to which the vane is coupled, can be formed through discharge machining or wire processing. This is because Ni—Cr—Mo steel is thermally treated to have a high level of hardness and to improve durability of the roller. Due to the high level of hardness of the thermally treated Ni—Cr—Mo steel, usual mechanical processing is hardly applied except the spark machining process or the wire processing process.

In the discharge machining process or the wire processing process, a radius of curvature designed from an outer diameter of the roller towards a vane coupling groove is hardly implemented due to limitations of the processes. The coupling groove of the roller in the rotary compressor of the related art can be processed up to an angle of 180 degrees or less of a circular arc due to high hardness of a material and limitations of processing methods.

A high level of hardness and processing difficulties of Ni—Cr—Mo steel of the related art can cause another problem in the rotary compressor of the related art.

The rotary compressor of the related art in FIG. 1 may not ensure surface contact between the vane and the roller due to limitations of a shape of the coupling groove of the roller, to which the vane is coupled. When line contact occurs between the vane and the roller at the coupling groove of the roller, a repulsive force caused by a difference between compression pressure and suction pressure in a compression chamber may increase frictional resistance force between a vane slot and the vane in a cylinder, where the vane moves back and forth, and may cause sliding loss.

Further, high hardness of Ni—Cr—Mo steel used as a material for a roller of the related art may directly affect the vane coupled to the coupling groove of the roller again.

Friction occurs between objects that contact each other and move all the time. In this case, a force preventing movements of the objects on the contact surface is referred to as a frictional force, and the frictional force is affected by physical properties of an object such as hardness as well as physical factors such as mass of an object, surface roughness of an object and the like.

A high level of hardness of Ni—Cr—Mo steel that is a material for a roller of the related art entails a high level of hardness of a vane coupled to the roller. The vane is a component that moves back and forth in a vane slot in a cylinder. Accordingly, the vane has to have higher hardness than the roller. However, high hardness of the vane makes it difficult to process of the vane, thereby causing a reduction in productivity.

In case hardness of the vane is not high enough, the vane and the roller can be worn out due to continuous friction between the vane and the coupling groove of the roller or between the vane and the vane slot, while the compressor moves back and forth rapidly. Wear on the vane may cause an increase in sliding loss of the compressor, and fragments caused by wear may trigger wear or damage to another component in the sealed compressor.

In the rotary compressor having a combined roller-vane structure, the vane is coupled to the roller. Accordingly, the vane can structurally affect movements of the roller. Ni—Cr—Mo steel that is a material for a roller of the related art has a relatively high coefficient of thermal expansion. In case a coefficient of thermal expansion of the roller becomes high, a tilt amount of the roller in a direction of a crank shaft increases. In this case, when the tilt amount of the roller increases, contact wear can occur due to interference between cross sections of the roller and a bearing supporting the roller.

SUMMARY

The present disclosure is directed to a rotary compressor that may precisely control a shape of a coupling groove of a roller in a combined roller-vane compressor, thereby ensuring surface contact between the coupling groove and a vane.

The present disclosure is directed to a rotary compressor that may be provided with a roller having wear resistance and reliability greater than a roller of the related art through control of hardness of the roller even when a roller having a lower hardness than a roller of the related art is used by controlling the hardness of the roller.

The present disclosure is also directed to a rotary compressor that may have wear resistance and reliability even when a vane of the present disclosure, coupled to a roller of the present disclosure having low hardness, has hardness the same as or lower than that of a vane of the related art.

The present disclosure is also directed to a rotary compressor that may ensure a clearance between a roller and a cylinder by lowering a coefficient of thermal expansion of the roller in a rotary compressor having a combined roller-vane structure, thereby enabling a reduction in wear on cross sections of a bearing and the roller and improving reliability.

The present disclosure is also directed to a rotary compressor that may ensure ease of precise processing of a coupling groove of a roller and a vane using the roller and the vane having low hardness and may ensure an increase in productivity, and to a manufacturing method of the rotary compressor.

Aspects of the present disclosure are not limited to the above-described ones. Additionally, other aspects and advantages that have not been mentioned can be clearly understood from the following description and can be more clearly understood from embodiments. Further, it will be understood that the aspects and advantages of the present disclosure can be realized via means and combinations thereof that are described in the appended claims.

As a means to achieve the above-described objectives, a rotary compressor according to the present disclosure may be provided with a roller having a ring shape, and may be provided with a coupling groove having a circular arc shape and coupled to a vane at an outer diameter portion of the roller.

The coupling groove may comprise a ferrosoferric oxide ($Fe_3O_4$) film on a surface thereof.

In case a length of a radius (R1) that determines the circular arc shape of the coupling groove is referred to as B, and a distance or a depth from a bottom of the coupling groove to a position, where the radius R1 of the coupling groove 341, and a radius of curvature of R2 at a position farthest away from the center of the roller of the coupling groove 341 meet each other, is referred as A, the rotary compressor according to the present disclosure may satisfy $B<A<2B$.

In this case, surface contact between the coupling groove of the roller and the vane may be made.

The vane may comprise a vane nose and a vane stem. The vane nose may be fixed to the coupling groove, and the vane stem may move back and forth in a vane slot disposed at one side of a cylinder.

The roller may have hardness of 150 to 300 on the basis of the Hv scale.

Preferably, a difference between hardness of the vane and hardness of the roller may be 450 or higher on the basis of the Hv scale.

The roller may be made of steel formed through sintering.

Preferably, the roller may be made of SMF 4040 steel.

More preferably, the roller may be made of SMF 4040 steel, and the vane may be made of SUJ2 bearing steel or STS440 stainless steel.

A maximum value of displacement in a direction of a crank shaft of the roller. i.e., a maximum value of displacement in a height-wise direction may be within 10.5 μm.

In this case, wear amounts of the roller and the vane may be controlled within 1.0 μm.

As a means to achieve the above-described objectives, a manufacturing method of a rotary compressor according to the present disclosure may comprise sintering of powder for sintering to manufacture a roller, and steaming of the sintered product.

Preferably, the sintered powder may be sintered steel.

Preferably, SMF 4040 steel may be used as the powder for sintering.

A compacting process of the powder may be added prior to the sintering process.

The sintering process may be carried out at 800 to 1,200° C. for 1 to 8 hours.

After the sintering process, a primary shaping process may be added.

After the primary shaping process, a turning process may be added.

The steaming process may be carried out at 500 to 600° C. by contacting between the primarily processed roller and water vapor.

The roller may have surface hardness of 150 to 300 on the basis of the Hv scale after the steaming process.

A secondary shaping process may be added after the steaming process.

The roller as a final product may comprise a ferrosoferric oxide ($Fe_3O_4$) film on a surface of a coupling groove.

Preferably, a difference between hardness of the vane and hardness of the roller as final products may be 450 or higher on the basis of the Hv scale.

A rotary compressor having a combined roller-vane structure according to the present disclosure may ensure surface contact between a roller and a vane through control of a shape of a coupling groove. Accordingly, the rotary compressor may use a roller having lower hardness than a rotary compressor of the related art or an existing rotary compressor having a roller-vane structure.

In the rotary compressor having a combined roller-vane structure, a roller having low hardness and a vane having high hardness are combined, thereby ensuring improved wear resistance of the roller and the vane and guaranteeing enhanced reliability of the compressor.

In the rotary compressor having a combined roller-vane structure, the roller may have lowered hardness such that a gap between the roller and a bearing is precisely controlled, thereby reducing a maximum value of displacement in a height-wise direction of the roller and reducing a wear amount between the roller and bearings.

Further, in the rotary compressor having a combined roller-vane structure, hardness of the roller may be lowered to readily process the roller, thereby ensuring significant improvement in productivity.

Detailed effects of the present disclosure are described together with the above-described effects in the detailed description of the disclosure.

BRIEF DESCRIPTION OF THE DRAWINGS

The accompanying drawings constitute a part of this specification, illustrate one or more embodiments of the present disclosure, and together with the specification, explain the present disclosure, wherein.

DETAILED DESCRIPTION

Figure 1:
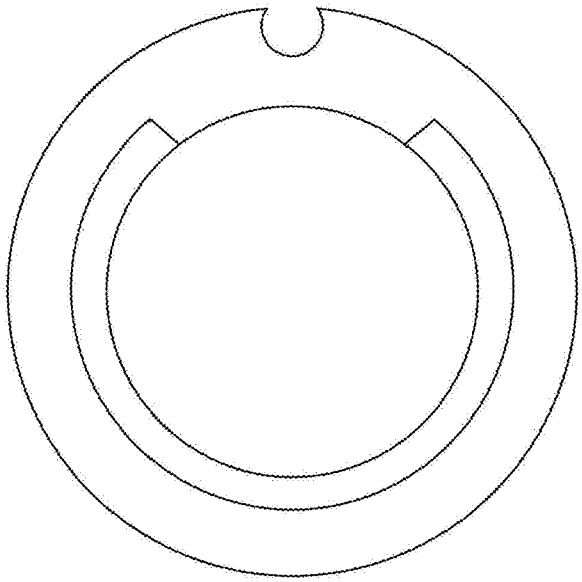
FIG. 1 Related Art
FIG. 1 is a cross sectional view illustrating shape of a roller of a rotary compressor of the related art.

The above-described aspects, features and advantages are specifically described with reference to the accompanying drawings hereunder such that one having ordinary skill in the art to which the present disclosure pertains may easily implement the technical spirit of the disclosure. During description in the disclosure, detailed description of known technologies in relation to the disclosure is omitted if it is deemed to make the gist of the present disclosure unnecessarily vague. Below, preferred embodiments according to the disclosure are described with reference to the accompanying drawings. Throughout the drawings, identical reference numerals denote identical or similar components.

When any component is described as being "at an upper portion (or a lower portion) of a component" or "on (or under)" a component, any component may be placed on the upper surface (or the lower surface) of the component, and an additional component may be interposed between the component and any component placed on (or under) the component.

In describing the components of the disclosure, when any one component is described as being "connected," "coupled" or "connected" to another component, any component may be directly connected or may be able to be directly connected to another component; however, it is also to be understood that an additional component may be "interposed" between the two components, or the two components may be "connected", "coupled" or "connected" through an additional component.

Below, a rotary compressor according to the present disclosure is specifically described with reference to embodiments.

Figure 2:
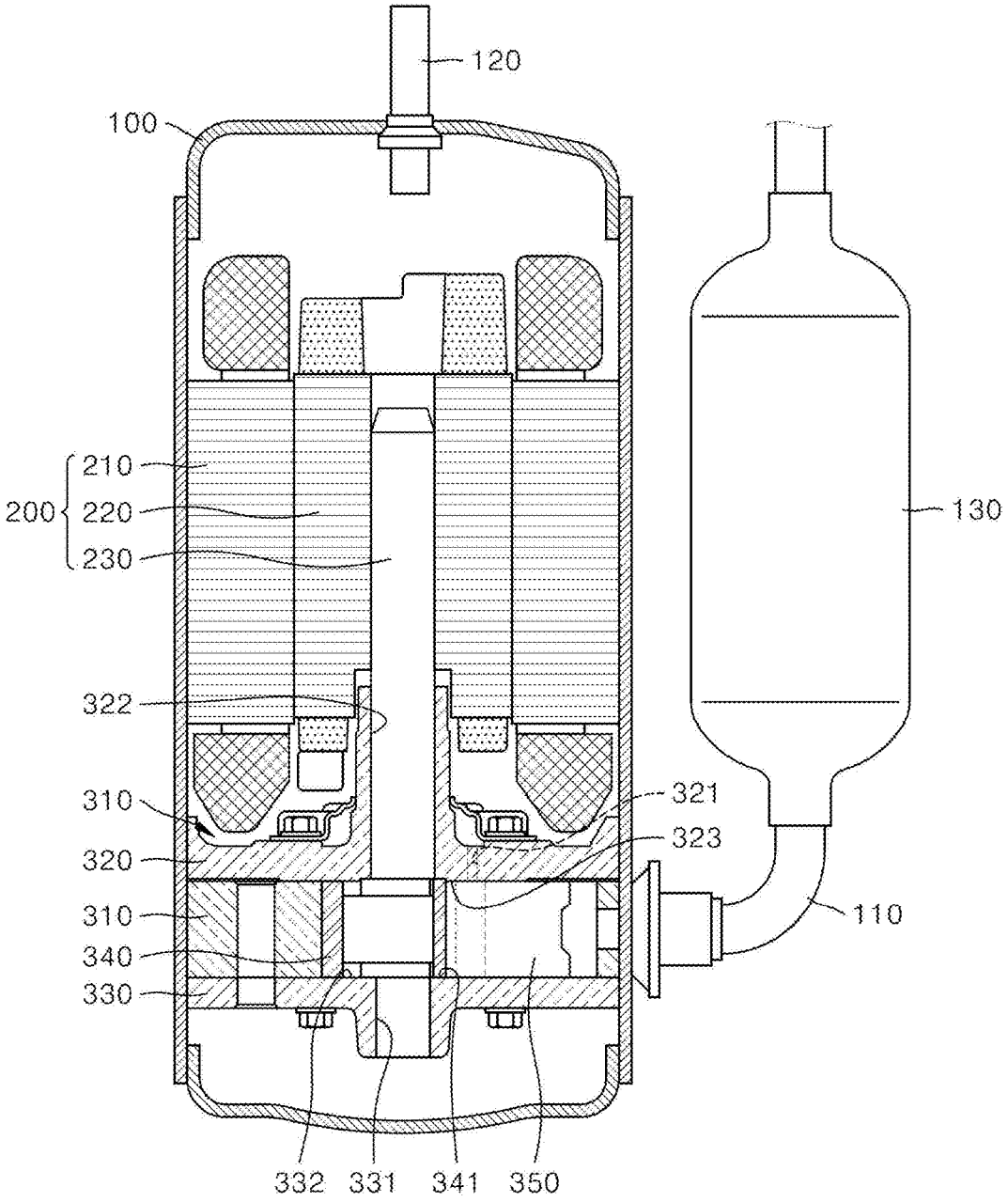
FIG. 2 is a cross-sectional view illustrating a rotary compressor according to an aspect of an embodiment.
Figure 3:
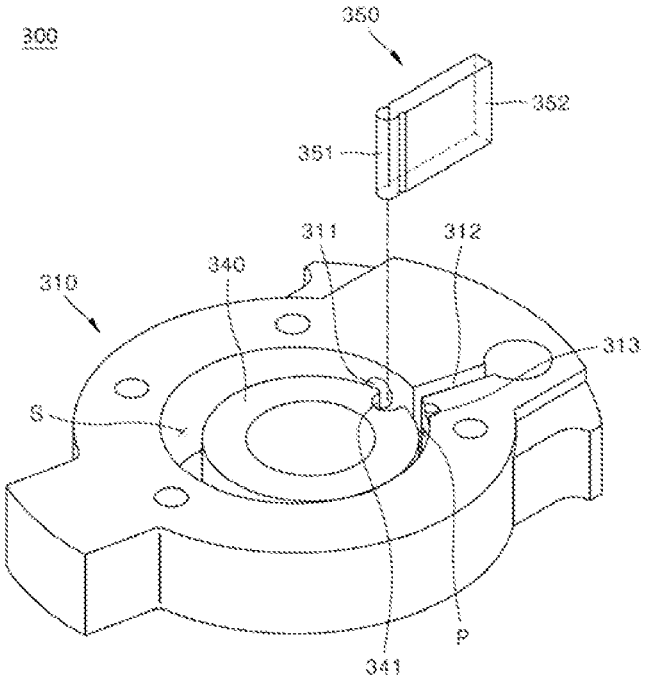
FIG. 3 is a perspective view illustrating a compression part of a rotary compressor according to an aspect of an embodiment.

FIGS. 2 and 3 are respectively a cross-sectional view illustrating a rotary compressor according to an aspect of an embodiment, and a perspective view illustrating a compression part 300 of a rotary compressor according to an aspect of an embodiment.

As illustrated in FIGS. 2 and 3, for a rotary compressor according to the present disclosure, a electric drive 200 may be disposed in an inner space of a sealed vessel 100, along with a compression part 300.

The electric drive 200 may comprise a stator 210 around which a coil is wound and which is fixed and installed in the sealed vessel 100, a rotor 220 which is rotatably disposed inside the stator 210, and a crank shaft 230 which is press-fitted to the rotor 220 and is configured to rotate along with the rotor.

The compression part 300 may comprise a cylinder 310 formed in a ring shape, an upper bearing 320 (or a main bearing) disposed at an upper portion of the cylinder 310, a lower bearing 330 (or a sub bearing) configured to cover a lower side of the cylinder 310, a roller 340 rotatably coupled to an eccentric part of the cranks shaft 230, configured to contact an inner circumferential surface of the cylinder 310 and disposed in a compression space of the cylinder 310, and a vane 350 coupled to the roller 340 and disposed to linearly move back and forth in a vane slot 312 disposed in the cylinder 310.

For the compression part 300, a suction space ('S') may be disposed on the left of the vane 350, and a compression space ('P') may be disposed on the right of the vane 350 with respect to the vane 350, in FIG. 2. As such, the vane 350 may be coupled to the roller and may separate the suction space and the compression space physically and stably.

In this case, a suction port 311 for suctioning refrigerants may be disposed at one side of the cylinder 310 in a radial direction of cylinder. Additionally, the vane slot 312, into which the vane 350 is inserted, may be disposed in a radial direction at the cylinder 310. A discharge port 321 for discharging refrigerants compressed in the compression space ('P') to the inner space of the sealed vessel 100 may be disposed at one side of the upper bearing 320.

The crank shaft 230 may be disposed at a central portion of each of the upper bearing 320 and the lower bearing 330, and journal bearing surfaces 322, 331 may be disposed at the central portion to support the crank shaft 230 in the radial direction. Additionally, thrust surfaces 323, 332 may be disposed on surfaces perpendicular to the journal bearing surfaces 322, 331, i.e., surfaces that constitute the suction space ('S') and the compression space ('P'), to support the crank shaft 230, the roller 340 and the vane 350 in an axial direction of the crank shaft 230. Thus, both lateral surfaces of the roller 340 and both lateral surface of the vane 350 may contact the upper bearing 320 and the lower bearing 330 with a gap (or a clearance) therebetween.

With the above-described configuration, the rotary compressor according to the present disclosure is operated as follows.

When power is supplied to the stator 210 of the electric drive 200, the rotor 220 is rotated by force generated by a magnetic field formed between the stator 210 and the rotor 220, and rotational force may be delivered to the crank shaft 230 passing through a center of the rotor 220. Accordingly, the roller 340, rotatably coupled to the crank shaft 230 and disposed in the compression space ('P' in FIG. 3) of the cylinder 310, may be rotatably coupled to the crank shaft 230, may make orbital movements by a distance at which the roller 340 is eccentrically disposed from the crank shaft 230.

While the compression space (P) is moved to a center by the orbital movements of the roller 340, volume of the compression space (P) may be reduced. Accordingly, refrigerant gases may be suctioned into the suction space (S), separated physically by the vane 350, through the suction port 311 of a suction pipe 110. The suctioned refrigerant gases may move along a discharge hole 313 while being compressed by the orbital movements of the roller 340, and then may be discharged to a discharge pipe 120 through the discharge port 321.

Figure 4:
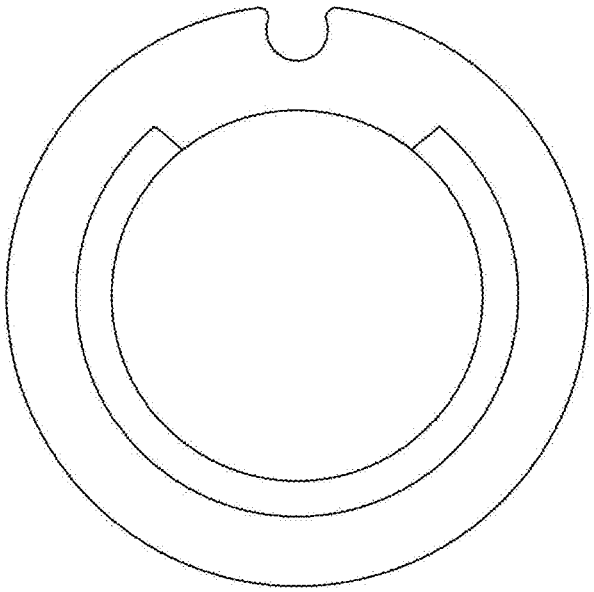
FIG. 4 is a cross-sectional view and a picture of a cross section of a roller according to an aspect of an embodiment.
Figure 4:
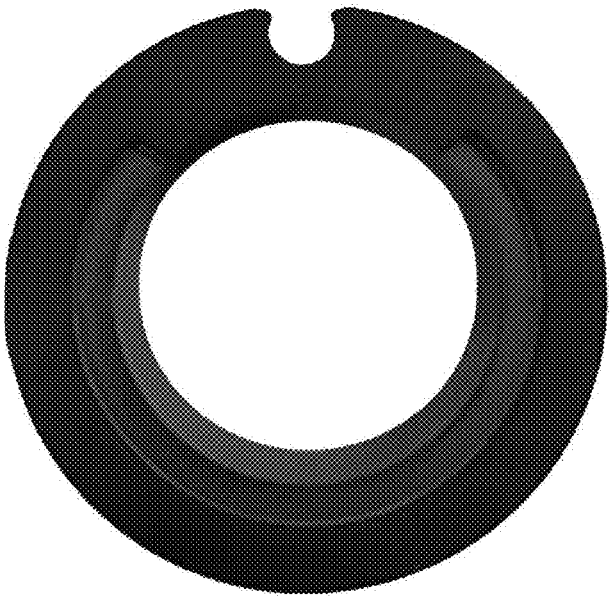

FIG. 4 is a cross-sectional view and a picture of a cross section of a roller 340 according to an aspect of an embodiment.

Figure 5:
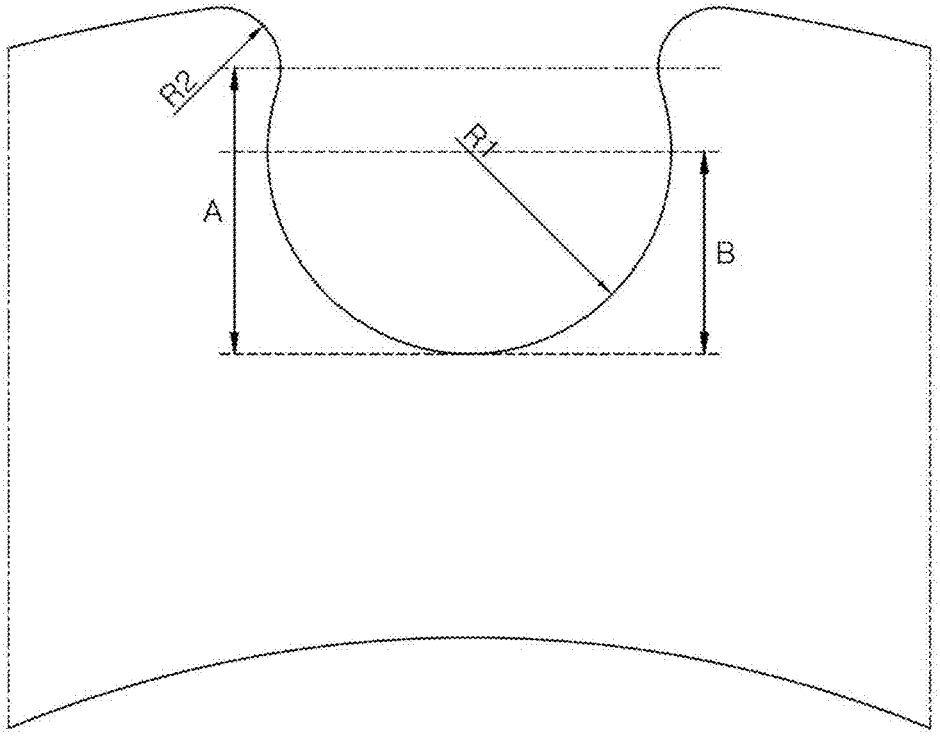
FIG. 5 is an enlarged cross-sectional view illustrating a coupling groove of a roller according to an aspect of an embodiment.

FIG. 5 is an enlarged cross-sectional view illustrating a coupling groove of a roller according to an aspect of an embodiment.

Figure 6:
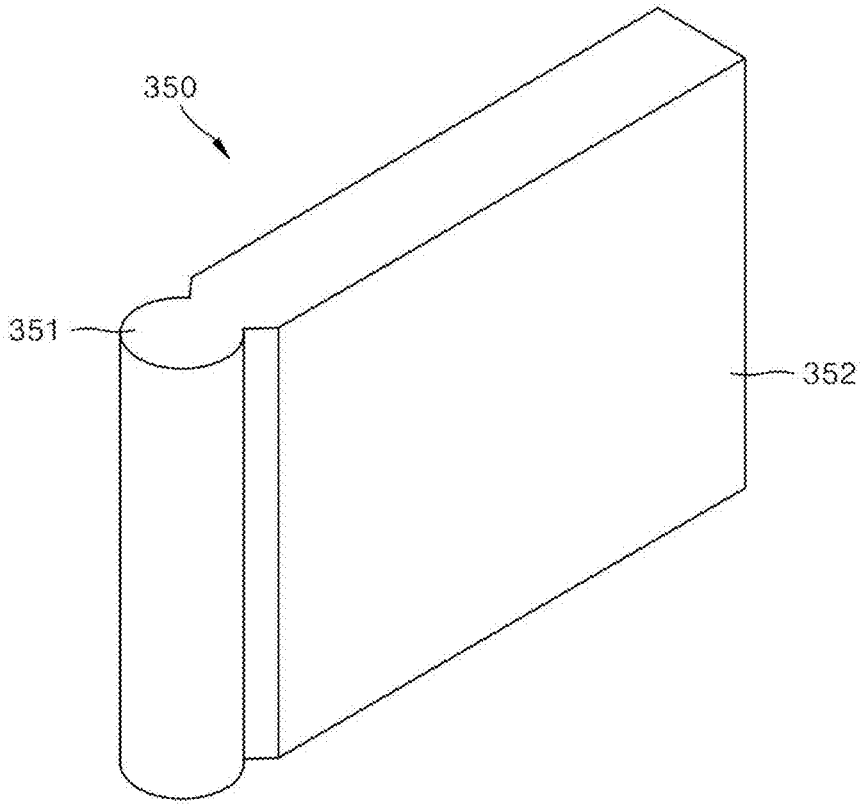
FIG. 6 is a perspective view illustrating a shape of a vane according to an aspect of an embodiment.

FIG. 6 is a perspective view illustrating a shape of a vane 350 according to an aspect of an embodiment.

The roller 340, as illustrated in FIGS. 3 to 6, may have a ring shape, and may be coupled to a crank shaft 230 eccentrically and rotatably, and a long coupling groove 341 of the roller 340 may be disposed in an axial direction of the crank shaft 230 at one side of an outer circumferential surface of the roller 340, i.e., a portion that contacts a vane 350, such that a nose 351 of the vane 350 is inserted into the coupling groove 341. Additionally, the vane 350 may comprise a vane stem 352 with the nose 351. Preferably, the vane stem 352 may be integrated into the nose 351. The vane stem 352 may connect with the nose 351, and when the roller 340 makes rotational movements, may be inserted into a vane slot 312 in a cylinder 310 and may move back and forth in the vane slot 312.

Unlike the roller of the rotary compressor of the related art in FIG. 1, the roller according to an aspect of an embodiment has the coupling groove 341 that is formed up to an angle of 180 degrees or greater of a circular arc of the roller 340 in a cross section perpendicular to an axial direction of the crank shaft 230. Accordingly, in the rotary compressor having a combined vane-roller structure, surface contact of the vane 350 and the coupling groove 341 of the roller 340 may be made instead of line contact.

The coupling groove 341 according to an aspect of an embodiment may have a circular arc shape having a radius of curvature of R1 as a whole (FIG. 5). Accordingly, the roller 340's coupling groove 341 having the circular arc shape may be fixed to the nose 351 of the vane 350. In this case, the coupling groove 341 fixed to the nose 351 of the vane 350 may be formed into a shape having a predetermined radius of curvature of R2 at a position farthest away from a center of the roller (i.e., a position where the coupling groove 341 starts to be formed from an outer diameter of the roller 340.

Preferably, the radius of curvature of R2 is smaller than the radius of curvature of R1 that determines the circular arc shape of the coupling groove 341. As the radius of curvature is limited, the coupling groove 341 and the vane 350 may be coupled to each other without escaping from each other. Further, a stable surface contact between the coupling groove 341 and the vane 350 may be ensured.

The shape of the coupling groove 341 may be limited to $B<A<2B$. In this case, B denotes a radius of R1 that determines the circular arc shape of the coupling groove 341. A denotes a distance or a depth from a bottom of the coupling groove 341 to a position where the radius curvature of R1, which determines the circular arc of the coupling groove 341, and the radius of curvature of R2 at a position farthest away from the center of the roller of the coupling groove 341 meet each other.

In case $B<A$ is not satisfied, the vane 350 may escape from the roller 340 while moving back and forth. Thus, the combined roller-vane structure of the present disclosure may not be maintained.

In case $A<2B$ is not satisfied, the radius of curvature of R2 at a boundary between the nose 351 and the vane stem 352 at the vane 350 has to become very small. Accordingly, force caused by a difference between pressure in the compression space and pressure in the suction space may be concentrated at the boundary and result in structural weakness of the boundary. Thus, the combined roller-vane structure and its durability may be deteriorated.

The roller 340 having the coupling groove 341, and the vane, according to an aspect of an embodiment, may be implemented using a new unlimited material and method.

Figure 7:
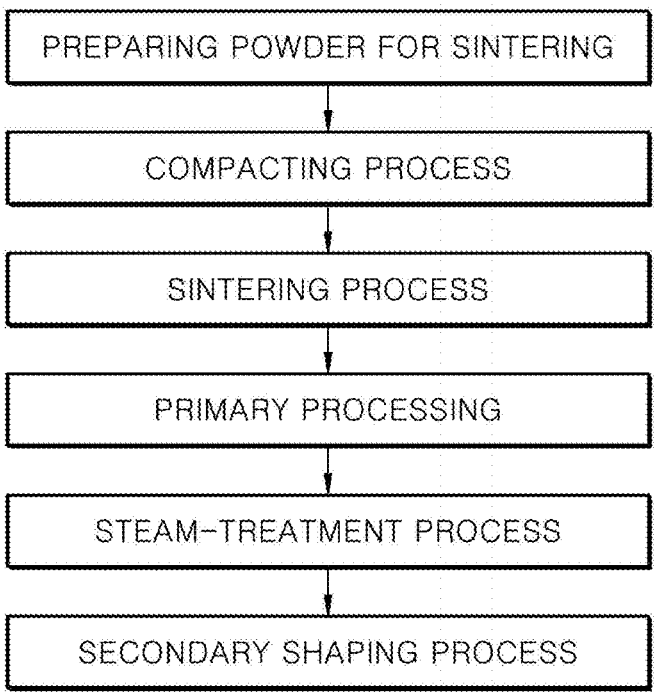
FIG. 7 is a mimetic view illustrating steps of a manufacturing method of a roller having a coupling groove according to an aspect of an embodiment.

FIG. 7 is a mimetic view illustrating steps of a manufacturing method of a roller 340 having a coupling groove 341 according to an aspect of an embodiment.

For the roller 340 in an embodiment of the present disclosure, powdered SMF (sinter metal ferrous) 4040 steel was used as start material. However, the start material for the roller 340 is not limited to SMF 4040 steel. In addition to SMF 4040 steel, all types of steel material, the shape of which is controlled by sintering and where hardness of a surface of the roller 340 may be controlled, may be used to manufacture the roller 340 as start material.

Physical properties, ingredients and a composition range of SMF 4040 steel are defined by a Japanese standard of JIS Z 2550:2000. Specifically, SMF 4040 steel may comprise 0.2 to 1.0 wt % of C, 1 to 5 wt % of Cu, and the rest wt % of Fe and other unavoidable impurities.

Next, the powder underwent a compacting process in a roller form, and then was manufactured as a half product of a roller through a sintering process.

The compacting process is a pretreatment process that is widely used in the field of powder metallurgy or ceramics, and a process in which a powdered raw material is charged into a mold having a desired shape and then is pressurized at room temperature or high temperature to maintain the desired shape on the basis of a physical or chemical coupling.

The sintering process is applied to manufacturing a bulk product from a powdered start material in the field of powder metallurgy or ceramics. In an initial step of the sintering process, necks are formed between powders of SMF 4040 steel by diffusion between the powders of SMF 4040 steel of the present disclosure. Then as the sintering process proceeds, the formed necks are coupled to each other and forms inner-connected pores. Then as the sintering process further proceeds, the inter-connected pores are separated, and isolated pores are formed in a way that each pore is individually present. In a later step of the sintering process, each of the isolated pores is filled with the powdered materials. Thus, a finally sintered product according to an aspect of an embodiment may have a shape of a bulk roller with density close to theoretical density.

In this case, the sintering process in an embodiment is preferably carried out at 800 to 1,200° C. for 1 to 8 hours.

In case the sintering process is carried out below the above-described temperature or for a period shorter than the above-described period, a temperature or a period for diffusion may not be ensured. Accordingly, a sintered product may have too many pores therein, and pores are too large. Thus, strength and hardness of a roller as a final product may not reach a level of required strength and hardness.

In case the sintering process is carried out above the above-described temperature or for a period longer than the above-described period, grain growth may occur in a sintered product after the sintering process. Accordingly, the finally sintered product has lower strength and elongation.

The sintered roller 340 undergoes first processing to be used as a roller.

The first processing in an embodiment may comprise a primary shaping process and a turning process.

The primary shaping process is a process in which an outer diameter of the semi-finished product, which previously underwent the compacting process and the sintering process, and a size and a shape of the coupling groove and the like are adjusted, such that the semi-finished product is applied to the combined roller-vane roller of the present disclosure.

After the primary shaping process, the sintered semi-finished product may further undergo the turning process such that a cross section, an inner diameter and a surface of the inner diameter and the like are processed.

Further, the brushing process may be included for precise dimension processing and surface processing.

Next, the primarily molded semi-finished product may be steamed to control surface properties, precisely, hardness of a surface, required by the combined roller-vane roller 340 of the present disclosure.

The steaming process may be heat treatment in which a steel product contacts water vapor at relatively high temperatures of 500 to 600□ and an oxide is formed on a surface of the steel product to enhance surface hardness of the steel product.

A typical change may be made on the surface of the steam-treated product. Specifically, a ferrosoferric oxide ($Fe_3O_4$) film may be formed on a surface of a steel product steamed according to the following chemical formula. The oxide film may excellently adhere to the surface of the steel product that is a base, and may have its unique black color (see picture in FIG. 4).

$$3Fe+4H_2O \rightarrow Fe_3O_4+4H_2$$

When necessary, the steam-treated product, i.e., the roller 340 may undergo a secondary shaping process.

The secondary shaping process in the present disclosure may correspond to the so-called sizing process, and may be a process of precisely processing the roller 340 according to an aspect of an embodiment, which was manufactured according to a series of the above-described manufacturing steps, on the basis of accurate design dimensions.

Additionally, when necessary, a process of polishing a cross section, an outer diameter and an inner diameter of the roller 340 may be added after the secondary shaping process.

However, the coupling groove 341 formed at a portion of the outer diameter of the roller 340 according to an aspect of an embodiment may not be additionally processed in the secondary shaping process. Accordingly, the roller according to an aspect of an embodiment is characterized in that the coupling groove 341 has a black oxide film comprising ferrosoferric oxide (see picture in FIG. 4) on its surface.

As described above, the roller 340, manufactured through the sintering process and the steaming process according to an aspect of an embodiment, had hardness of about 150 to 300 on the basis of the Hv scale (the Vickers hardness). The hardness of the surface of the roller 340 according to an aspect of an embodiment is much lower than hardness (Hv 550) of a roller 340 manufactured through quenching and tempering of SNCM 815 steel of the related art.

Below, features of a rotary compressor having a combined roller-vane roller according to an aspect of an embodiment are described with reference to experimental examples.

Experimental Example 1—Analysis of Tilt Amount

Figure 8:
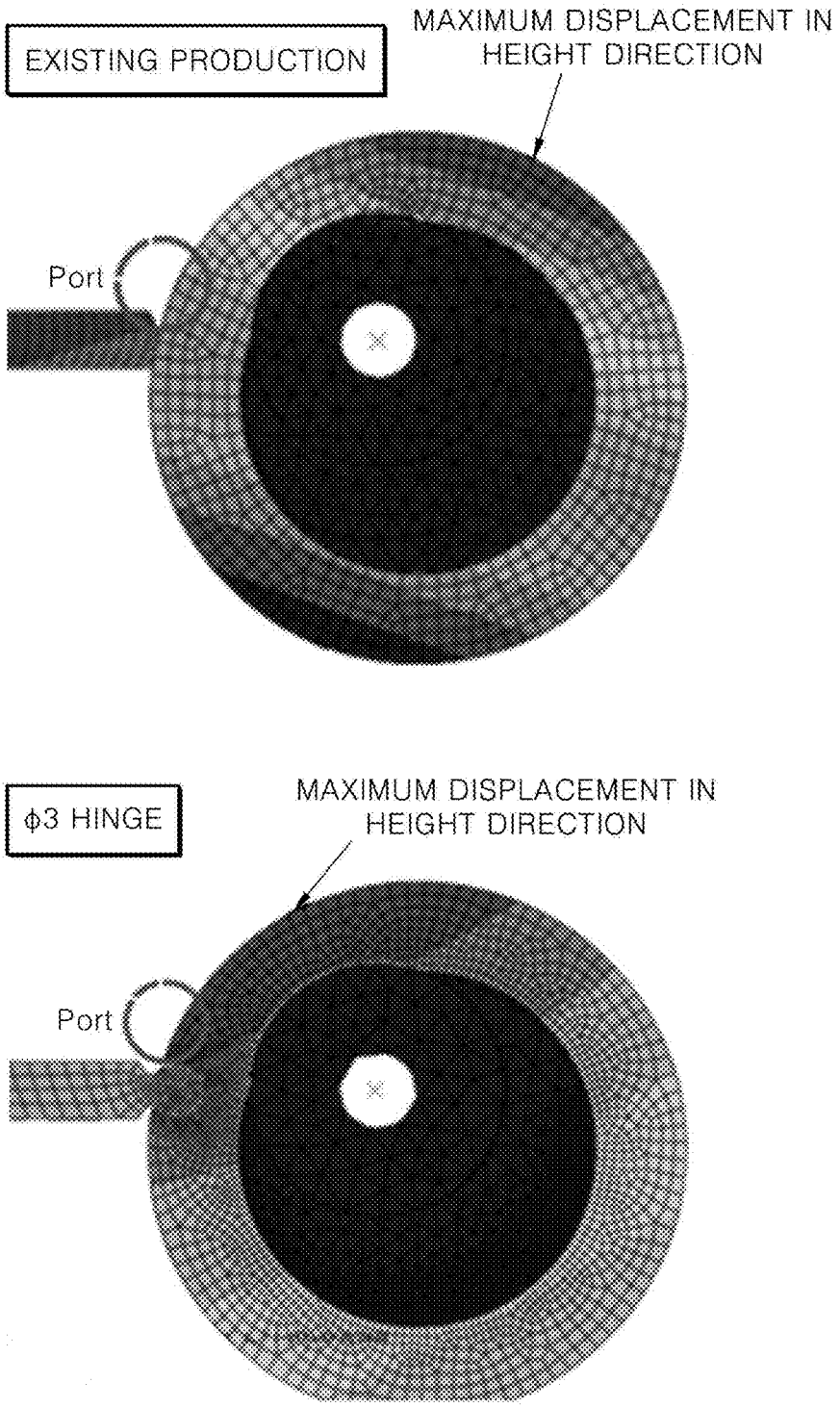
FIG. 8 is a view showing results of comparison between tilt amounts of a rotary compressor having a roller-vane structure of the related art and a rotary compressor having a combined roller-vane structure.

FIG. 8 shows results of analysis of a tilt amount of a roller respectively in a rotary compressor having a roller-vane structure (not a combined roller-vane structure) of the related art and in a rotary compressor having a combined roller-vane structure.

As illustrated in FIG. 8, in the rotary compressor of the related art, a maximum displacement in a height-wise direction of the roller may be at a position spaced a significant distance apart from the vane. On the contrary, as the vane is coupled to the roller in the combined roller-vane structure, the vane may be structurally affected by an eccentric rotation of the roller. Thus, a maximum displacement in the height-wise direction of the roller may be at a position near the vane.

As shown in the shadow of FIG. 8, movements of the roller may be limited by the vane in the case of the combined roller-vane structure. Thus, the combined roller-vane structure has a maximum displacement larger than that of the roller-vane structure (not a combined roller-vane structure) of the related art in the height-wise direction (a direction of the crank shaft) of the roller.

The maximum displacement in the height-wise direction of the roller varied depending on a material of the roller even in rotary compressors having the same combined roller-vane structure.

Below, Table 1 shows results of calculation of a maximum value of displacement in a height-wise direction of a roller through simulation on the basis of materials of the roller, in the roller-vane structure of the related art and in the combined roller-vane structure. The calculation in simulation was performed under conditions of suction and discharge pressures which were respectively 5 kgf/cm$^2$ and 39 kgf/cm$^2$, and of revolutions per second (rps) of 130.

TABLE 1

| | Maximum Value of Displacement in Height-Wise Direction of Roller | | |
|---|---|---|---|
| | Structure of related art | Combined structure (Mo—Ni—Cr roller) | Combined structure (Sintered roller) |
| Maximum displacement in height-wise direction | 9.6 μm | 12.3 μm | 10.3 μm |

A maximum value of displacement in the combined roller-vane structure having a sintered roller according to an aspect of an embodiment was about 20% lower than in a combined roller-vane structure having a roller made of Ni—Cr—Mo steel. Additionally, as a result of calculation, the combined roller-vane structure of the sintered roller of the present disclosure had almost the same level of a maximum value of displacement as the roller-vane structure of the related art. In the case of the combined roller-vane structure having the sintered roller according to an aspect of an embodiment, as a result of calculation, a maximum value of displacement of the roller was within 10.5 μm even when a clearance between the roller and the cylinder changes.

The results of calculation in Table 1 accord with results of actual measurement.

Figure 9:
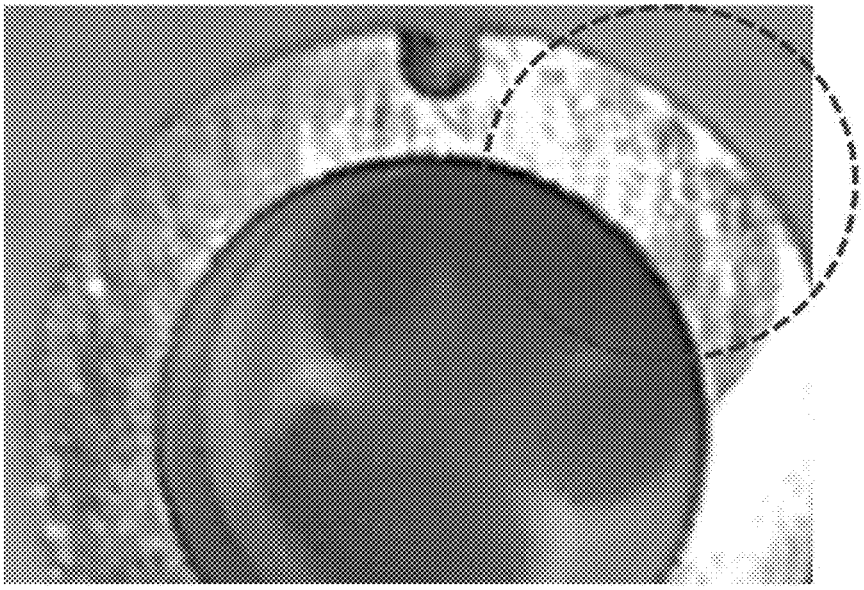
FIG. 9 is a view illustrating results of a reliability test of a rotary compressor having a combined roller-vane structure with a roller made of Ni—Cr—Mo steel of the related art.
Figure 9:
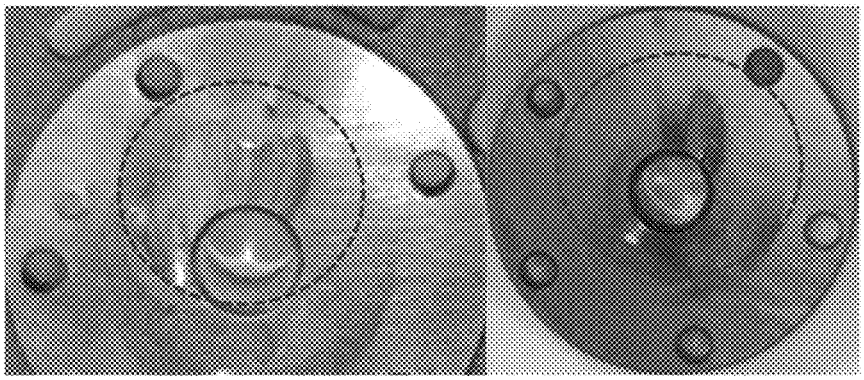

FIG. 9 is a view showing results of a reliability test of a rotary compressor having a combined roller-vane structure with a roller made of Ni—Cr—Mo steel.

Figure 10:
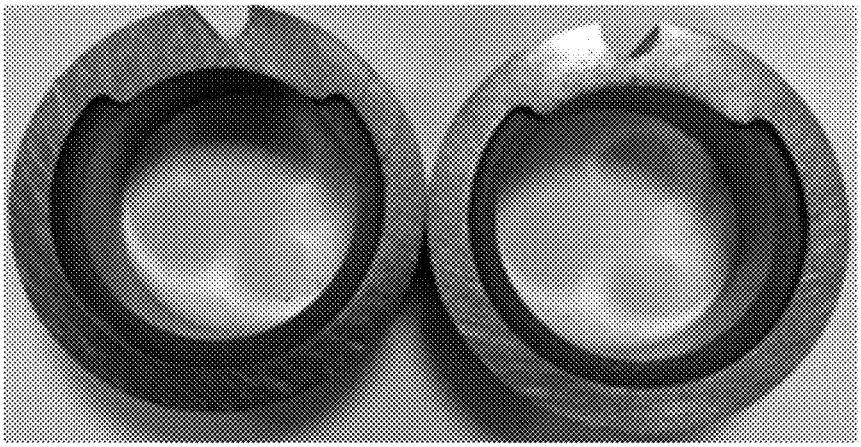
FIG. 10 is a view illustrating results of a reliability test of a rotary compressor having a combined roller-vane structure with a sintered roller according to the present disclosure.
Figure 10:
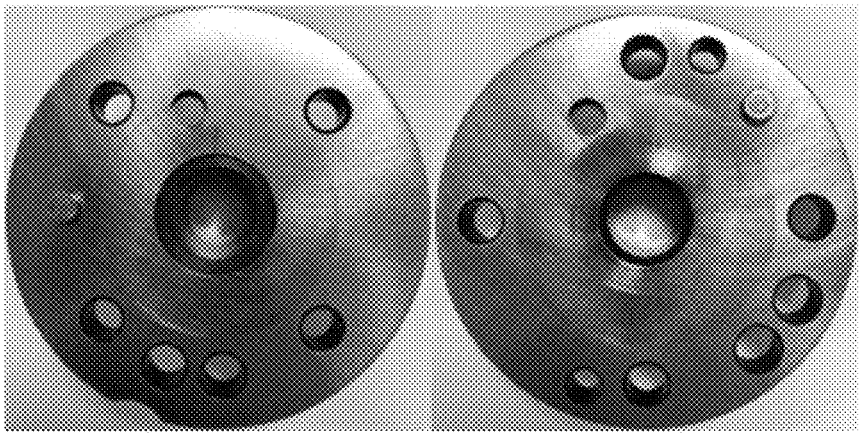

FIG. 10 is a view illustrating results of a reliability test of a rotary compressor having a combined roller-vane structure with a sintered roller according to the present disclosure.

The reliability tests in FIGS. 9 and 10 were performed under the same conditions such as suction and discharge pressures which were respectively 3 kgf/cm$^2$ and 42 kgf/cm$^2$ for 168 hours. However, revolutions per second (rps) of the sintered roller in FIG. 10 was 150 Hz while rps of the roller of the related art in FIG. 9 was 130 Hz. A condition for the reliability test of the sintered roller in FIG. 10 was harsher than in the roller of the related art in FIG. 9.

As a result of the reliability test, the roller made of existing Ni—Cr—Mo steel experienced wear on the cross sections of a main bearing and a sub bearing. Further, the cross section of the roller, which contacted the bearings, was partially torn away due to the wear (FIG. 9).

On the contrary, the roller manufactured through sintering according to an aspect of an embodiment remained in its initial state without wear on a cross section of a roller as well as a cross section of a bearing (see FIG. 10).

FIGS. 9 and 10 clearly show that the reliability of the sintered roller according to an aspect of an embodiment is greater than the roller made of Ni—Cr—Mo steel of the related art.

Experimental Example 2—Analysis of Wear Amount

Below, Table 2 shows results of analysis of wear amounts of a roller and a bearing in the rotary compressor having a combined roller-vane structure on the basis of materials of the roller and the vane.

TABLE 2

Wear Amount of Combined Roller-Vane Structure

| Pair | Mode | Wear amount of vane | Wear amount of roller | Result of analysis |
|---|---|---|---|---|
| STS440 QT(Hv 1,000) vane + Mo—Ni—Cr QT(Hv 550) roller | 37 MPa | 1.2 | 1.8 | Δ |
| SUJ2(Hv 700-900) vane + Mo—Ni—Cr QT(Hv 550) roller | 37 MPa | 6.5 | 10.2 | X |
| SUJ2(Hv 700-900) vane + SMF4040 steamed (Hv 200) roller | 37 MPa | 0.2 | 0.6 | ○ |

The roller made of existing Ni—Cr—Mo steel has high hardness of about Hv 550. Accordingly, a vane coupled to the roller has to have high hardness. In this context, martensite-based stainless steel such as STS440 stainless steel (0.6 to 0.75 wt % of C, 1.0 or less wt % of Si, 1.0% or less wt % of Mn, 0.04 or less wt % of P, 0.03 or less wt % of S, 16.0 to 18.0 wt % of Cr, and the rest wt % of Fe and unavoidable impurities), where hardness may be enhanced through quenching, has been commonly used for a vane of the related art.

In a rotary compressor having a combined roller-vane structure comprising a vane made of STS 440 stainless steel that is a commercial product, and a roller made of Ni—Cr—Mo steel, the vane and the roller all had a significant wear amount (respectively, 1.2 μm and 1.8 μm).

Hardness (Hv 900) of SUJ2 steel, the ingredients and composition range of which are defined by the JIS G4805 standard, which is widely used as bearing steel, and which comprises 0.95 to 1.10 wt % of C, 0.15 to 0.35 wt % of Si, a maximum of 0.5 wt % of Mn, 0.025 or less wt % of P, 0.025 or less wt % of S, 1.30 to 1.60 wt % of Cr, 0.25 or less wt % of Cu, 0.25 or less wt % of Ni, 0.08 or less wt % of Mo, and the rest wt % of Fe and unavoidable impurities, was lower than that of STS440 stainless steel of the related art after the quenching process. The rotary compressor having a combined roller-vane structure that comprises the vane made of SUJ2 steel and the roller made of Ni—Cr—Mo steel had a wear amount larger than that of a rotary compressor of having a combined roller-vane structure of the related art that comprises a STS 404 steel vane and a Mo—Ni—Cr steel roller.

A rotary compressor having a combined roller-vane structure comprising a SMF 4040 sintered and steamed roller and a SUJ2 steel vane according to an aspect of an embodiment had wear properties more improved than the rotary compressor having a combined roller-vane structure of the related art comprising a STS 404 steel vane and a Mo—Ni—Cr steel roller. Further, in terms of an wear amount of the rollers, when the vanes were made of the same material (SUJ2 steel), the SMF 4040 sintered and steamed roller had a wear resistance 17 times greater than that of the Mo—Ni—Cr steel roller, although hardness of the roller decreased from 550 to 200 on the basis of the Hv scale.

Figure 11:
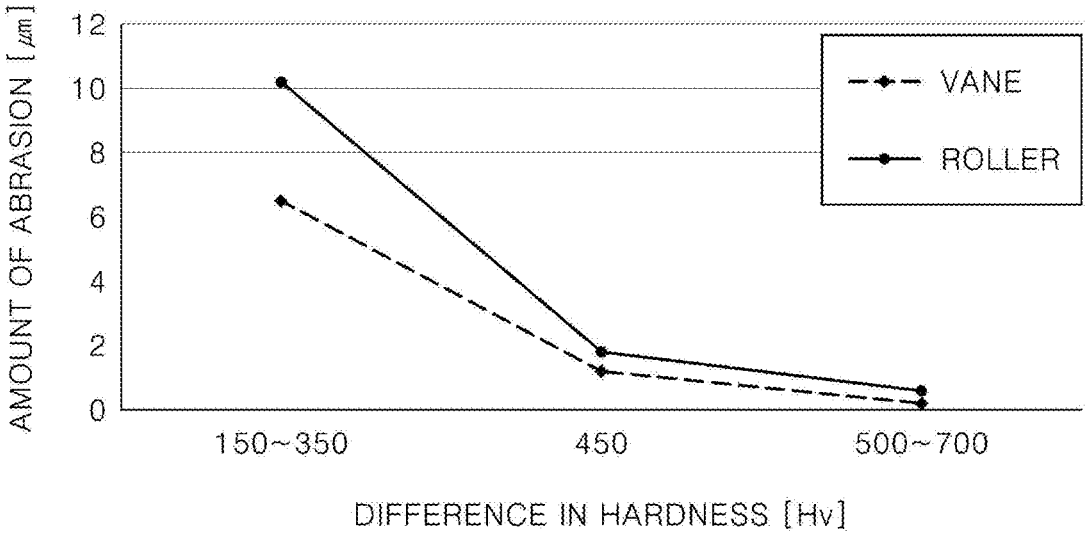
FIG. 11 is a view illustrating wear amounts of a vane and a roller on the basis of a difference between hardness of the vane and hardness of the roller in a combined roller-vane structure.

The results shown in FIG. 2 are firmly supported by FIG. 11.

FIG. 11 is a view illustrating wear amounts of a vane and a roller on the basis of a difference between hardness of the vane and hardness of the roller in a combined roller-vane structure.

As shown in FIG. 11, in the combined roller-vane structure, a difference between hardness of a vane and hardness of a roller has a greater effect on wear properties than each value of the hardness of the vane and the hardness of the roller. FIG. 11 clearly shows that when hardness of a roller is lower than hardness of a vane by 500 or higher on the basis of the Hv scale, a rotary compressor having a combined roller-vane structure may have improved wear properties and improved reliability.

The present disclosure has been described with reference to the embodiments illustrated in the drawings. However, the disclosure is not limited to the embodiments and the drawings set forth herein. Further, various modifications may be made by one having ordinary skill in the art within the scope of the technical spirit of the disclosure. Further, though not explicitly described during the description of the embodiments of the disclosure, effects and predictable effects based on the configuration of the disclosure should be included in the scope of the disclosure.

What is claimed is:

1. A rotary compressor, comprising:

a cylinder that defines an inner space configured to receive refrigerant, the cylinder further defining a vane slot that is connected to the inner space and extends in a radial direction of the cylinder;

a roller that is disposed in the inner space of the cylinder, that has a ring shape, and that is configured to compress the refrigerant in the cylinder, the roller defining a coupling groove that has a circular arc shape and is recessed from an outer circumferential surface of the roller toward a center of the roller; and a vane disposed in the vane slot and configured to move along the vane slot, the vane being configured to couple to the coupling groove of the roller and to divide the inner space of the cylinder into a suction space and a compression space, wherein the roller comprises a ferrosoferric oxide ($Fe_3O_4$) film disposed on a surface defining the coupling groove, wherein the roller is made of SMF 4040 steel comprising 0.2 to 1.0 wt % of carbon (C), 1 to 5 wt % of copper (Cu), iron (Fe), and impurities, wherein the vane is made of SUJ2 bearing steel or STS440 stainless steel, wherein the SUJ2 bearing steel comprises 0.95 to 1.10 wt % of C, 0.15 to 0.35 wt % of silicon (Si), 0.5 or less wt % of manganese (Mn), 0.025 or less wt % of phosphorus (P), 0.025 or less wt % of sulfur (S), 1.30 to 1.60 wt % of chromium (Cr), 0.25 or less wt % of Cu, 0.25 or less wt % of nickel (Ni), 0.08 or less wt % of molybdenum (Mo), Fe, and impurities, and wherein the STS440 stainless steel comprises 0.6 to 0.75 wt % of C, 1.0 or less wt % of Si, 1.0 or less wt % of Mn, 0.04 or less wt % of P, 0.03 or less wt % of S, 16.0 to 18.0 wt % of Cr, Fe, and impurities.

2. The rotary compressor of claim 1, wherein the roller has a hardness of 150 to 300 in an Hv scale.

3. The rotary compressor of claim 2, wherein a difference between a hardness of the vane and the hardness of the roller is 450 or higher in the Hv scale.

4. The rotary compressor of claim 2, wherein the SMF 4040 steel is sintered steel.

5. The rotary compressor of claim 1, wherein the roller is configured to, based on the vane coupling to the coupling groove, have a displacement in an axial direction of the roller, the displacement being less than or equal to 10.5 μm with respect to a reference plane.

6. The rotary compressor of claim 1, wherein the coupling groove comprises:

a recessed portion that is disposed inside the roller and has a first radius of curvature with respect to a groove center inside the coupling groove; and an inlet portion that extends outward from the recessed portion to the outer circumferential surface of the roller, the inlet portion having a second radius of coverture, wherein the inlet portion has an inner end connected to the recessed portion and an outer end connected to the outer circumferential surface of the roller, and wherein a distance from an innermost point of the recess portion to the inner end of the inlet portion is greater than the first radius of curvature and less than a double of the first radius of curvature.

7. The rotary compressor of claim 1, wherein each of the roller and the vane is configured to wear by 1.0 μm or less from an initial size.

8. A method for manufacturing a rotary compressor, the rotary compressor including a cylinder that defines an inner space configured to receive refrigerant, the cylinder further defining a vane slot that is connected to the inner space and extends in a radial direction of the cylinder, a roller that is disposed in the inner space of the cylinder, that has a ring shape, and that is configured to compress the refrigerant in the cylinder, the roller defining a coupling groove has a circular arc shape and is recessed from an outer circumferential surface of the roller toward a center of the roller, and a vane disposed in the vane slot and configured to move along the vane slot, the vane being configured to couple to the couple groove of the roller and to divide the inner space of the cylinder into a suction space and a compression space, the method comprising:

providing powder for sintering;

compacting the powder in a mold having a shape corresponding to the roller;

sintering the compacted powder;

performing a primary shaping process to adjust a shape of the roller detached from the mold;

based on performing the primary shaping process, steaming the roller; and based on steaming the roller, performing a secondary shaping process to further adjust the shape of the roller, wherein the roller comprises a ferrosoferric oxide ($Fe_3O_4$) film disposed on a surface defining the coupling groove, wherein the roller is made of SMF 4040 steel comprising 0.2 to 1.0 wt % of carbon (C), 1 to 5 wt % of copper (Cu), iron (Fe), and impurities, wherein the vane is made of SUJ2 bearing steel or STS440 stainless steel, wherein the SUJ2 bearing steel comprises 0.95 to 1.10 wr/o of C, 0.15 to 0.35 wt % of silicon (Si), 0.5 or less wt % of manganese (Mn), 0.025 or less wt % of phosphorus (P), 0.025 or less wt % of sulfur (S), 1.30 to 1.60 wt % of chromium (Cr), 0.25 or less wt % of Cu, 0.25 or less wt % of nickel (Ni), 0.08 or less wt % of molybdenum (Mo), Fe, and impurities, and wherein the STS440 stainless steel comprises 0.6 to 0.75 wt % of C, 1.0 or less wt % of Si, 1.0 or less wt % of Mn, 0.04 or less wt % of P, 0.03 or less wt % of S, 16.0 to 18.0 wt % of Cr, Fe, and impurities.

9. The method of claim 8, wherein the powder for sintering comprises sintered steel.

10. The method of claim 8, wherein sintering the compacted powder is performed at 800 to 1,200° C. for 1 to 8 hours.

11. The method of claim 8, wherein steaming the roller comprises contacting the roller with water vapor at 500 to 600° C.

12. The method of claim 11, wherein the steamed roller has a surface hardness of 150 to 300 in an Hv scale.

13. The method of claim 12, wherein a difference between a hardness of the vane and a hardness of the roller is 450 or higher in the Hv scale.

14. The method of claim 8, wherein the ferrosoferric oxide ($Fe_3O_4$) film on the surface defining the coupling groove is formed by steaming the roller.

15. The method of claim 14, wherein the secondary shaping process is performed at an area of the roller outside the coupling groove to thereby maintain the ferrosoferric oxide film on the coupling groove.

16. The method of claim 8, further comprising:

performing a turning process after the primary shaping process to process an inner surface of the roller.

* * * * *